United States Patent [19]

Datta

[11] 4,097,617

[45] Jun. 27, 1978

[54] PHOSPHONITRILE FLUOROELASTOMER COATED CARRIER PARTICLES FOR USE IN ELECTROPHOTOGRAPHIC PROCESS

[75] Inventor: Pabitra Datta, Cranbury, N.J.

[73] Assignee: Addressograph-Multigraph Corporation, Cleveland, Ohio

[21] Appl. No.: 831,147

[22] Filed: Sep. 7, 1977

[51] Int. Cl.[2] ..... G03G 9/10; G03G 9/14

[52] U.S. Cl. ..... 427/14; 252/62.1 P; 252/62.54; 260/2 P; 260/42.14; 427/127; 427/221; 428/403; 428/404; 428/406; 428/407

[58] Field of Search ..... 427/14, 19, 215, 216, 427/220, 221, 127; 428/403, 404, 405, 406, 407, 421, 422; 252/62.1 P, 62.54; 260/2 P, 42.14; 46/150

[56] References Cited

U.S. PATENT DOCUMENTS

| | | | |
|---|---|---|---|
| 3,271,330 | 9/1966 | Evans | 260/2 P |
| 3,438,773 | 4/1969 | Hayashi et al. | 252/62.1 P |
| 3,798,167 | 3/1974 | Kukla et al. | 252/62.1 P |
| 3,838,073 | 9/1974 | Rose et al. | 260/2 P |
| 3,888,799 | 6/1975 | Rose et al. | 260/2 P |

*Primary Examiner*—Ronald H. Smith
*Assistant Examiner*—Stuart D. Frenkel
*Attorney, Agent, or Firm*—Michael A. Kondzella

[57] ABSTRACT

Coated carrier particles for use in an electrophotographic process are prepared by applying a thin coating of a phosphonitrile fluoroelastomer to the surface of the carrier particles. The coated carriers are long lived and capable of imparting a negative triboelectric charge to electroscopic powders mixed therewith.

8 Claims, 2 Drawing Figures

PHOSPHONITRILE FLUOROELASTOMER COATED CARRIER PARTICLES FOR USE IN ELECTROPHOTOGRAPHIC PROCESS

BACKGROUND OF THE INVENTION

This invention relates to carriers for use in developer formulations which charge electroscopic powders triboelectrically. These carriers are useful in electrophotographic processes for developing latent electrostatic images in which a colored toner carried by the carrier particle is caused to be attracted from the carrier particle to develop the latent electrostatic image.

In the electrophotographic process it is necessary to use a carrier for the toner in order to produce an electrostatic charge upon the toner particles. Various kinds of developing processes are known including cascade, powder cloud and magnetic brush processes. In each of these processes it is necessary that the carrier particles used have certain triboelectric properties so that they are capable of imparting to the toner particles an electrostatic charge of the proper polarity and magnitude.

Recently, it has been found that the carrier particles can be coated with certain types of polymeric coatings to permit variation in the triboelectric properties thereof. One such method is disclosed in U.S. Pat. No. 3,811,880 to Luther C. Browning, assigned to the same assignee as this invention.

Although polymeric coatings of this type enable a certain degree of control of the triboelectric properties of the developer mix, it has been found that in use in the environment of electrophotographic reproduction machines such carrier particles are subject to aging which limits their effectiveness. Wearing away and removal of part of the polymeric coating upon the surface of the carrier particles is another problem encountered. This may result in undesired abrasion of the photoconductive surface used for imaging and also cause bias shorting.

Another problem inherent in the use of such polymeric coatings for carrier particles is the phenomenon known as "bound toner." Through a mechanism which is not clearly understood prolonged usage of developer mixes including polymeric coated carrier particles results in toner being adhered onto the surface of the coated carrier causing a decrease in the effectiveness of the toning process and hence in the overall development of the images being reproduced.

OBJECTS

It is accordingly an object of this invention to provide carriers for toners which are not subject to the disadvantages mentioned above.

Another object of this invention is to provide carrier particles which have an enhanced longevity.

Another object of this invention is to provide carrier particles which are capable of imparting desired triboelectric properties to various types of toners.

It is another object of this invention to provide carrier particles in which "bound toner" is reduced.

Other objects and advantages of this invention will become apparent in the following detailed disclosure and description.

SUMMARY OF THE INVENTION

Carrier particles coated with a phosphonitrile fluoroelastomer can be used in developer mixes in order to increase the useful life of the developer and also to provide desired triboelectric properties by imparting a negative triboelectric charge to electroscopic powders mixed therewith. Such carriers have an enhanced longevity and are relatively more durable than carriers previously used. A more efficient carrier with respect to triboelectric properties, a carrier having low surface energy and a low coefficient of friction and a carrier which does not need to be replenished as frequently as other types of carriers is thereby provided.

DESCRIPTION OF THE PREFERRED EMBODIMENTS

Figure 1:
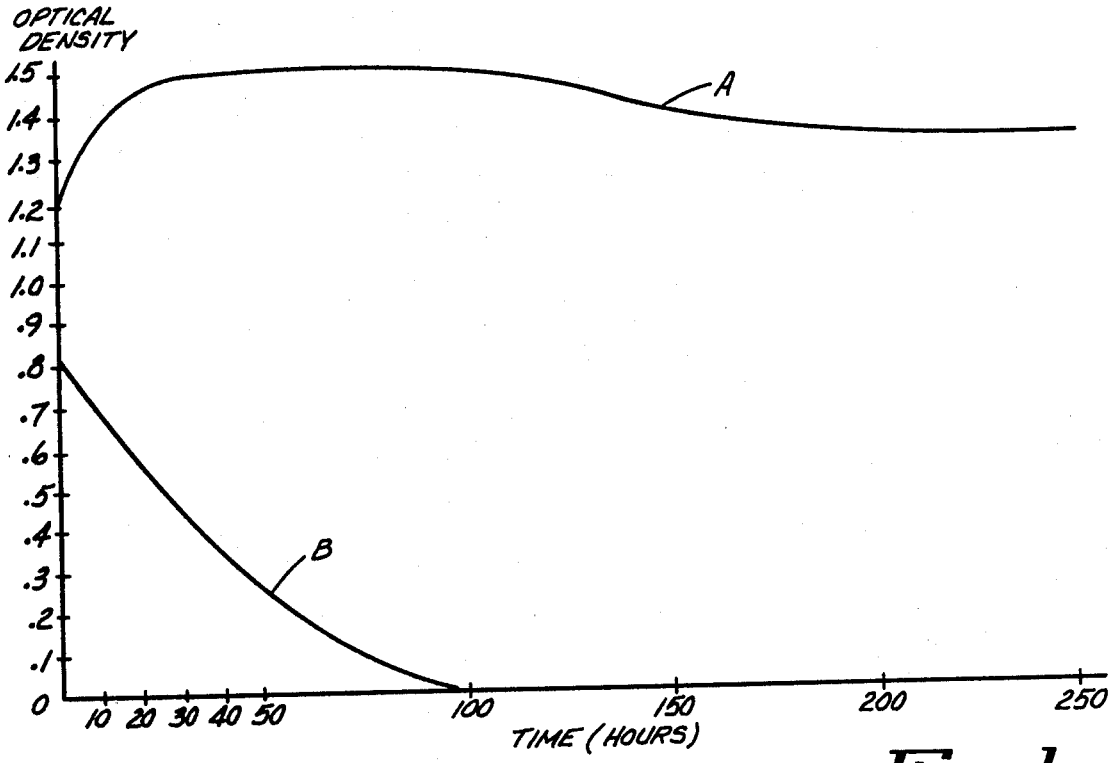
FIG. 1 is a series of curves showing variation in optical density of copies produced as a function of the running time of the developing unit of an electrophotographic copying machine for various types of carriers.

It has been found that the various problems encountered with previously available carriers are generally obviated by the use of a carrier particle to the surface of which is applied a thin coating of a phosphonitrile fluoroelastomer.

The phosphonitrile fluoroelastomers contemplated by the invention are derivatives of poly(dichlorophosphazene). They may be represented by the formula

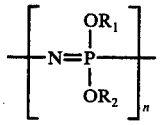

where $R_1$ and $R_2$ are fluorinated alkyl radicals which may be the same or different. For example $R_1$ and $R_2$ may be trifluoromethyl, trifluoroethyl, octafluoropentyl, perfluoroethyl, perfluorobutyl or perfluoropentyl. These polymers are prepared by alkoxylating poly(dichlorophosphazene) by reaction with an appropriately fluorinated sodium alkoxide.

Phosphonitrile fluoroelastomers have low gloss transition temperatures and are rubbery materials at room temperature. They are characterized by a low surface energy. Poly[bis(perfluoro-t-butoxy)phosphonitrile], for example has a surface energy of about 10–14 dynes/cm.

As carrier matrix materials it is possible to use a wide variety of substances, for example glass beads, ceramic beads, grains of sand or metallic particles. Non-metallic matrix materials are useful where a cascade development system is utilized although metallic matrices can also be used in cascade development. Where a magnetic brush developing system is used it is necessary that the matrix be magnetic. For this purpose various irons and steels have been used, for example, spherical steel beads and irregularly shaped iron powders.

Coating of the carrier matrix material is accomplished by a process which will thoroughly mix the carrier matrix particles and the phosphonitrile fluoroelastomer to achieve uniform coating of the carrier matrix. A fluidized bed coating apparatus has been found particularly adaptable to the coating operation although other coating techniques can also be used. In using the fluidized bed coating method, the carrier matrix material is loaded into the fluidized bed coating apparatus and air under pressure is then passed into the apparatus. A solution of the selected phosphonitrile fluoroelastomer in a suitable solvent is pumped through an atomized spray nozzle at a rate such that uniform coatings occur. Spraying may be repeated as many times as desired to obtain the particular thickness of coating required. The resulting coated particles are finally dried in a fluidized bed oven.

The resulting carriers are found to have a longer useful life than prior art carriers in the hostile environment of electrophotographic development. Because these carriers have a low surface energy, reduced toner filming, characterized as "bound toner" is realized. In addition the adherence of the phosphonitrile fluoroelastomer to the carrier matrix material reduces flaking, chipping and spalling of the carrier. Further, the triboelectric properties of the carriers of this invention are such that most toners will be charged with a negative polarity when used with these carriers.

With the outstanding triboelectric properties of the carriers of this invention and the physical properties mentioned above, namely the low surface energy, the low coefficient of friction and the pronounced adherence of the phosphonitrile fluoroelastomer to the carrier matrix material these carriers represent a significant improvement over carriers which have been previously used. In addition to the long life of the carriers themselves the particular combination of properties increases the life of the photoconductor used in the electrophotographic process and also results in very high quality copies being produced.

The durability and effectiveness of these carriers is greatly enhanced because of the coating of phosphonitrile fluoroelastomer upon the surface of the carrier matrix material.

Another advantage of the carriers of this invention is that the toner filming or "bound toner" determined using various commercially available toners with these carriers is considerably less than in the case of previously available carrier particles. The low percentage of "bound toner" indicates that the carriers of this invention can be used much more successfully than previously available carriers since their efficiency is not reduced by toner filming upon the carrier particles to the same extent as prior art carriers.

This invention will be better understood by reference to the following examples which are intended to illustrate but not to unnecessarily limit the scope of the invention, which is defined in the claims appended hereto.

EXAMPLE 1

A 2 kilogram quantity of 175 micron average particle size spherical steel beads was cleaned with trichloroethane in an ultrasonic cleaner and then dried in a fluidized oven at 80° C. The cleaned and dried beads were then loaded into a fluidized bed coating apparatus, air was introduced at 15 cubic feet per minute and the frequency of the apparatus was adjusted to 6,000 rpm. A 10 gram quantity of poly[bis(perfluoroamyloxy)phosphonitrile] was dissolved in 400 grams of acetone. The polymer which had a critical surface energy or surface tension of 16 dynes per centimeter was pumped through an atomizing spray nozzle and applied to the beads in the fluidized bed coating apparatus in 60 spray cycles at 3 minute intervals. The resulting coated carrier particles were then dried in a fluidized bed oven at 100° C. for 1 hour.

EXAMPLE 2

A quantity of 1,500 grams of the coated carrier particles of Example 1 was mixed with 22.5 grams of a toner containing polyamide resin, maleic modified rosin, styrene-allyl alcohol copolymer, polyethylene, lithium stearate, carbon black and a positive orienting dye. The mixture of coated carrier particles and toner was poured into the toning unit of an Addressograph-Multigraph Model 2000 electrostatic copier. Zinc oxide coated electrostatic paper was charged negatively and exposed to light from a tungsten filament light bulb through a transparent glass target. The latent image was developed by passing through the toning unit four times. The optical density of the copies produced was determined by means of a Macbeth RD-519 densitometer.

A curve showing optical density as a function of the running time of the Addressograph-Multigraph Model 2000 electrostatic copier was plotted and is shown as curve A of FIG. 1. One hour running time is equivalent to approximately 1,200 copies. Using this developer mix excellent copies were produced up to about 250 hours running time, the equivalent of about 300,000 copies.

By way of comparison the results using uncoated spherical steel beads are plotted in curve B of FIG. 1. It can be seen from this curve that the optical density drops off very rapidly to an unacceptable level when uncoated carrier particles are used.

Figure 2:
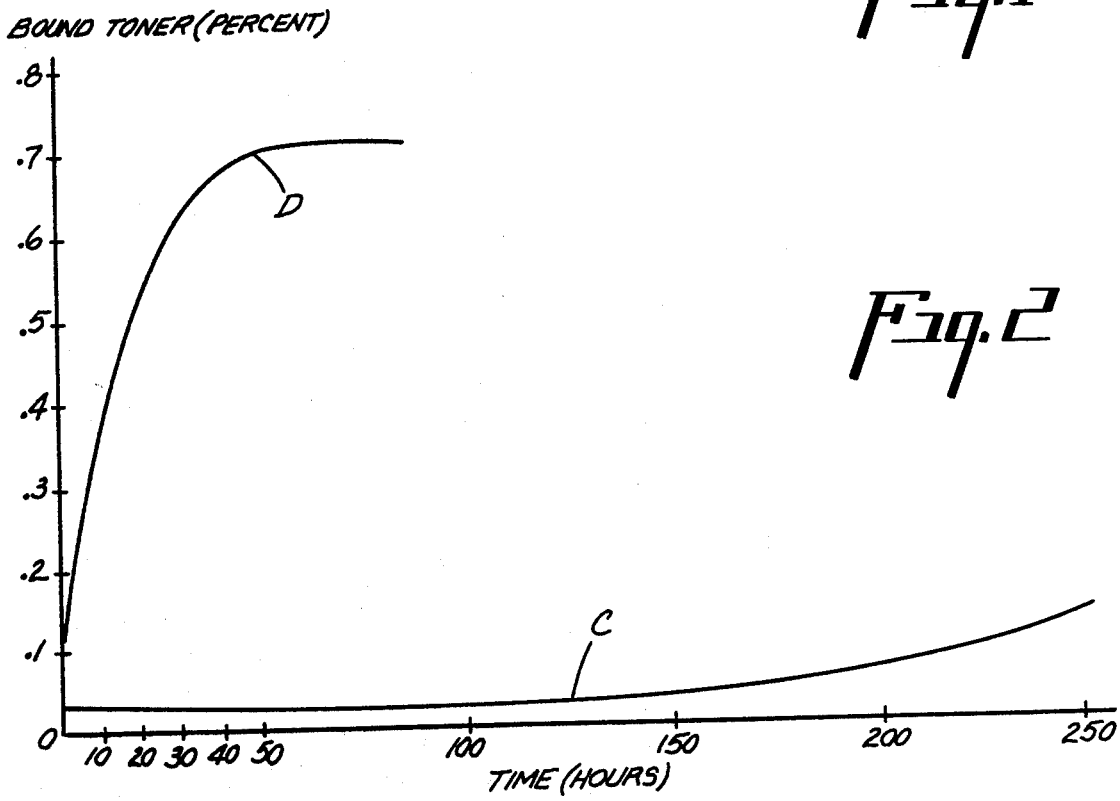
FIG. 2 is a series of curves showing bound toner as a function of the running time for various types of carriers.

Percentage of bound toner was determined using the analytical technique described in Denshi Shashin (Electrophotography) 10, 14 (1971). The analytical results are plotted in curve C of FIG. 2 which shows the percentage of bound toner as a function of the running time. For comparison purposes the results using uncoated carrier particles are shown in curve D of FIG. 2.

Triboelectric properties of the toner subjected to frictional contact with the coated carrier particles of Example 1 were determined in the following manner.

A sheet of toner about 1 mm. thick was formed upon a steel plate by melting the toner onto the metal. The resulting toner sheet was then gently rubbed in the carrier and the carrier was removed by shaking or lightly vacuuming the toner sheet.

The triboelectric interaction between the toner sheet and carrier deposited a surface charge on the toner sheet. The surface charge caused a voltage drop across the toner sheet which was then measured with a non-contact voltmeter such as a Monroe Electronics "Isoprobe."

For a sheet of dielectric of area A, thickness $t$, dielectric constant K and bulk resistivity $\rho$, with a surface charge density of $+\sigma$ on the top surface and $-\sigma$ on the bottom surface the equivalent circuit is a capacitor of capacity $$C = K\epsilon_o A/t$$

in parallel with a resistance $$R = \rho t/A$$

with a voltage across the plates of $$V = \sigma t/K\epsilon_o$$

where $\epsilon_o$ is the permittivity of free space.

The surface charge density, $\sigma$ associated with the toner-carrier triboelectric interaction was thus easily calculated from the measured voltage drop across the toner sheet, the dielectric constant and the thickness of the sheet.

The sheet thickness was determined by measuring the thickness of the sheet plus metal plate with calipers and subtracting the measured thickness of the base metal plate. The sheet dielectric constant was determined in the standard manner by (1) measuring the capacitance of the sheet placed between electrodes of known area and (2) dividing that value by the calculated unloaded capacitance of the electrodes separated by a space equal to the sheet thickness.

Toner sheets made by carefully melting the toner powder onto the plate were often found to have edges slightly lower than the centers. In order to avoid any inaccuracies occasioned by the method of sheet preparation care was taken to measure the voltage only in the regions where the thickness was uniform and easy to measure.

Using the above described technique the surface charge density $\sigma$ of the toner due to triboelectric interaction between the toner sheet and the carrier of Example 1 was found to be $-4.4 \times 10^{-10}$ coulomb per square centimeter.

EXAMPLE 3

A quantity of 150 grams of the coated carrier particles of Example 1 was mixed with 2.2 grams of a toner containing copolymers of styrene and n-butyl methacrylate, maleic modified rosin, polyvinyl stearate and carbon black.

Zinc oxide coated electrostatic paper was charged negatively by means of a corona discharge using a potential of 5,000 volts, exposed through a photographic transparency and toned with a hand held magnetic brush using the resulting developer mixture. Positive images having an optical density of 1.4 were obtained.

The surface charge density was found to be $-1.0 \times 10^{-10}$ coulomb per square centimeter.

EXAMPLE 4

The procedure of Example 2 was repeated using a toner containing polyamide resin, maleic modified rosin, polyallyl alcohol, carbon black and a positive orienting dye. The surface charge density was found to be $-5.2 \times 10^{-10}$ coulomb/cm$^2$.

EXAMPLE 5

The procedure of Example 2 was followed using a toner containing copolymers of styrene and butyl methacrylate, carbon black and a negative orienting dye. The surface charge density was found to be $-4.9 \times 10^{-10}$ coulomb/cm$^2$.

It can thus be seen that the carriers of this invention can be used to produce good positive copies using a variety of toners. Particularly noteworthy is the apparent ability of the carriers of this invention to impart a negative charge to many different types of toner. Also noteworthy is the long life of such carriers and of developers in which they are incorporated and the very low degree of toner filming (bound toner) experienced using these carriers.

EXAMPLE 6

The carrier of Example 1 was ball milled with 4% of the toner of Example 4 for various periods of time in an accelerated test for toner filming. The results are shown in Table 1.

TABLE 1

| Time, hr. | Bond Toner, % |
|---|---|
| 0.5 | 0.03 |
| 1 | 0.03 |
| 4 | 0.03 |
| 16 | 0.3 |
| 48 | 0.7 |

This invention has been described with respect to a limited number of specific embodiments. However, it is intended that alternative compositions and methods may be used and it should be understood that this invention is not to be limited except in accordance with the claims appended hereto.

I claim:

1. A carrier for use in electrophotographic development of latent electrostatic images capable of inducing an electrostatic charge in a toner mixed therewith which comprises a member selected from the group consisting of metallic particles and siliceous particles to the surface of which is adhered a phosphonitrile fluoroelastomer.

2. A composition according to claim 1 wherein said phosphonitrile fluoroelastomer is poly[bis(perfluoroamyloxy)phosphonitrile].

3. A composition according to claim 1 wherein said particles are magnetic.

4. A composition according to claim 1 wherein said particles are non-magnetic.

5. A composition according to claim 1 wherein said particles are iron.

6. A composition according to claim 1 wherein said particles are spherical metal beads.

7. A process for developing a latent electrostatic image which comprises mixing an electroscopic powder with a carrier comprising a member selected from the group consisting of metallic particles and siliceous particles to the surface of which is adhered a phosphonitrile fluoroelastomer to impart opposite electrostatic charges to said electroscopic powder and said carrier, whereby said electroscopic powder is attracted to said carrier and transferring said electroscopic powder from said carrier to said latent electrostatic image.

8. A process according to claim 7 wherein a negative elastrostatic charge is imparted to said electroscopic powder.

* * * * *